US006210061B1

(12) United States Patent
Johnson

(10) Patent No.: US 6,210,061 B1
(45) Date of Patent: Apr. 3, 2001

(54) DISPENSING APPARATUS

(76) Inventor: Robbin Lee Johnson, 750 Hayden Ave., Akron, OH (US) 44320

( * ) Notice: Under 35 U.S.C. 154(b), the term of this patent shall be extended for 0 days.

(21) Appl. No.: 09/330,678

(22) Filed: Jun. 11, 1999

(51) Int. Cl.[7] ..... B43K 5/06
(52) U.S. Cl. ..... 401/175; 401/174; 401/171
(58) Field of Search ..... 401/175, 174, 401/173, 172, 171, 176, 179

(56) References Cited

U.S. PATENT DOCUMENTS 5,000,356 3/1991 Johnson et al. ..... 222/391
5,025,960 * 6/1991 Seager ..... 401/175
5,372,444 * 12/1994 Lhuisset ..... 401/175
5,842,802 * 12/1998 Lang et al. ..... 401/175

* cited by examiner

*Primary Examiner*—David J. Walczak
(74) *Attorney, Agent, or Firm*—Emerson & Associates; Roger D. Emerson; John M. Skeriotis

(57) ABSTRACT

An apparatus for dispensing cream products such as deodorants and the like from a concealed product tube. A rotatable propeller drives a threaded spindle having a piston elevator mounted thereon. As the spindle rotates, the piston elevator rides upward, pushing the product toward an application surface.

13 Claims, 8 Drawing Sheets

DISPENSING APPARATUS

BACKGROUND OF THE INVENTION

1. Field of Invention

The present invention relates primarily to a dispensing apparatus for the dispensing deodorant cream emulsions, antiperspirants and the like, and more particularly, to a novel dispensing apparatus having a dispensing tube assembly encased in an outer housing that minimizes post-dispensing of the product.

2. Description of the Related Art

Prior art deodorant dispensers often dispense the deodorant product by the displacement of a piston elevator advancing upward in response to rotation of a hand-wheel. The consequent pressurization of the deodorant product causes residual pressure to be exerted and thereby cause undesirable weeping of the product.

Efforts to address this problem has led to the development of product dispensers that allow seepage of the deodorant product from between the junction of the base and the sidewalls of the dispenser. In these systems, vent holes that are provided for the depressurization beneath the elevator piston causes the product to leak or exude from the dispensing package onto the surface where the dispenser is stored.

U.S. Pat. No. 5,000,356 discloses a dispensing package designed to relieve the residual pressure on a cream product and also dispense the product in incremental doses. The piston elevator axially advances and retracts as a feed screw is rotated. A plurality of internal cams cause reciprocal motion of the piston elevator. During the advancement of the piston elevator, the product is dispensed and during retraction, the residual pressure is relieved.

None of the prior art dispensing systems accomplishes the objects of the present invention of having an internal dispensing assembly encased in an outer housing that minimizes post-dispensing of the product.

SUMMARY OF THE INVENTION

The present invention relates to a novel dispensing-package that finds use in dispensing cosmetic creams, lotions and deodorants. This novel designed dispenser provides a product tube situated within an outer housing. Rotation of the product tube dispenses the product in controlled dosage increments while minimizing unwanted weeping of the product.

In typical use, the user manually rotates a propeller, which then causes axial displacement of a piston elevator. The upward advancement of the piston elevator causes the deodorant product to be dispensed through orifices in an application surface where it is subsequently applied to the axillae of the user. The present invention provides means for reciprocal motion of the piston elevator in order to relieve the residual pressure exerted on the product and thereby control undesirable post-dispensing. The present invention also provides means for uniform dispensing of the product by audible and/or tactile sensations.

In accordance with one aspect of the present invention, a dispensing apparatus is provided which comprises a hollow housing having a central longitudinal axis and a container wall; an application cap secured to the container wall at the top of the housing, the application cap having an application surface having a central opening therein and a downwardly extending flange located about the central opening; a hollow product tube having a bottom wall and an open top end, the product tube being received within the housing and being spaced from the container wall, the product tube being disposed about the longitudinal axis and being adapted to contain an associated product; a rotatable threaded spindle disposed along the longitudinal axis, a first end of the spindle being received in a spindle well located in the bottom wall of the product tube; a piston elevator being mounted onto the spindle for axial movement within the product tube; rotational prevention means for preventing rotation of the piston elevator about the spindle; rotatable drive means for rotation of the threaded spindle, the drive means being fixedly secured to a second end of the spindle, the drive means comprising a rotatable propeller and a hollow product head having an upper surface and an open lower end, the product head being affixed to the propeller and rotatable therewith, the open lower end of the product head communicating with the open top end of the product tube and the upper surface of the product head being received within the flange of the application cap; directing means for directing the associated product from the product tube to the application surface, the directing means comprising a plurality of orifices in the upper surface of said product head; and, association means for maintaining a predetermined association between the housing, the product tube and the drive means.

According to another aspect of the invention, the dispensing apparatus further comprises means for reciprocating the product head within the flange of the application cap. The reciprocating means may comprise a cam located at a bottom of the flange; a cam follower being rotatable with the product head and contacting the cam; and, a flexible strip extending between the product head and the propeller, the flexible strip being able to displace axially in response to movement of the cam follower along the cam.

According to another aspect of the invention, the bottom wall of the product tube is integrally molded with the housing.

According to another aspect of the invention, the product tube, the container wall and the base are a single integrally molded member.

According to another aspect of the invention, the bottom wall of the product tube includes a plurality of vent holes therein.

According to another aspect of the invention, the dispensing apparatus includes means for dispensing a uniform dose of said associated product.

One advantage of the present invention is that the deodorant dispenser has very few parts to substantially reduce the manufacturing and assembly costs.

Another advantage of the present invention is the provision of a concealed product tube within a dispenser housing. This arrangement provides for much neater application of product and storage of the dispensing package.

Still other benefits and advantages of the invention will become apparent to those skilled in the art to which it pertains upon a reading and understanding of the following detailed specification.

DESCRIPTION OF THE PREFERRED EMBODIMENT

Figure 1:
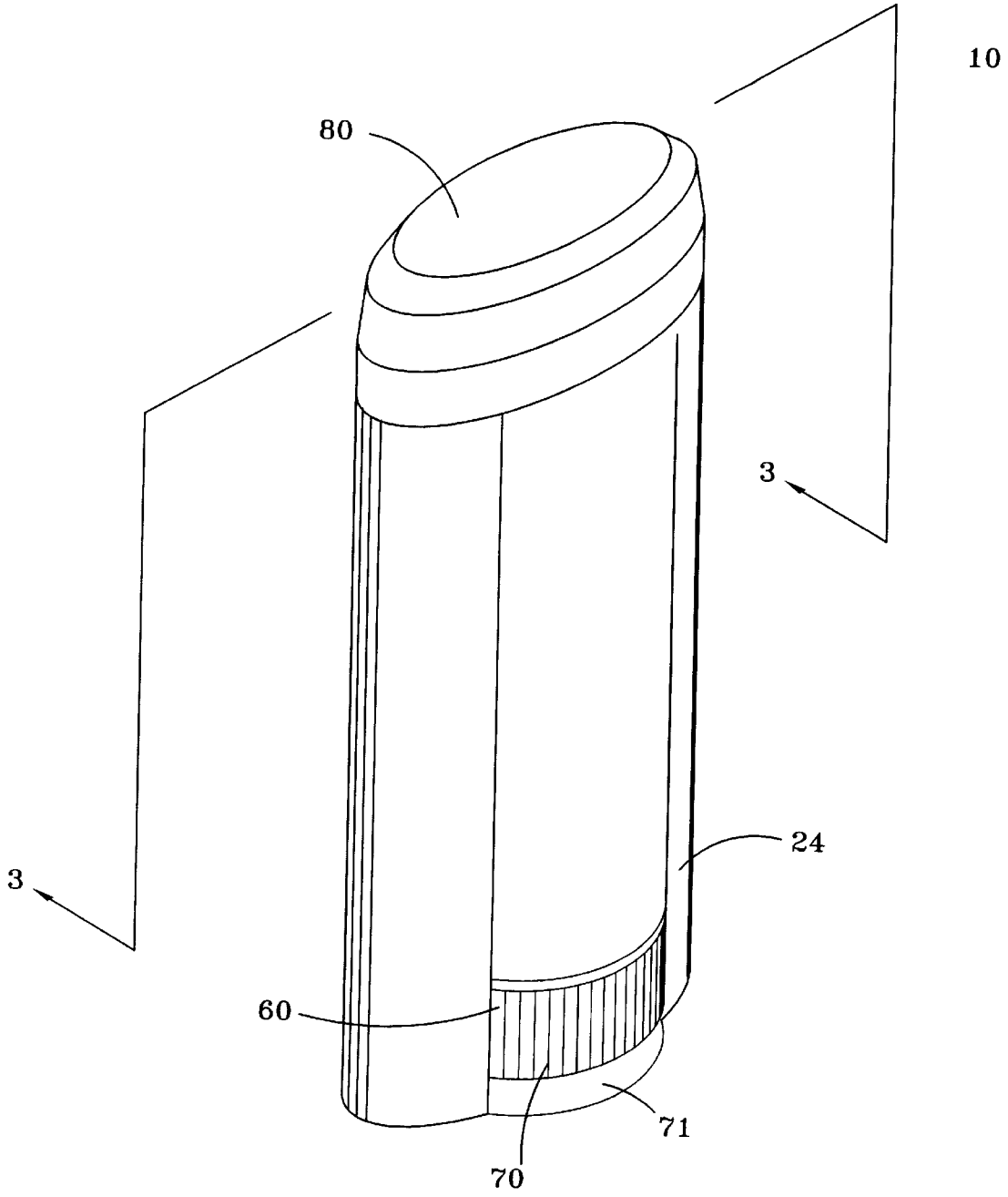
FIG. 1 is a perspective view of a dispensing apparatus according to the present invention.

With reference to FIG. 1, a preferred embodiment of the present is illustrated wherein a deodorant or other product is enclosed in a dispensing apparatus 10. The apparatus 10 comprises a housing 24 that is made of a suitable material, such as molded polypropylene. The dispensing apparatus 10 further includes a removable cap 80 which allows selective access to an application surface (not shown in this view). Cap 80 performs the conventional functions of protecting the product from contaminants and retaining the product within the dispensing apparatus 10 when not in use. The product is dispensed through rotation of a propeller 60 having a partially exposed region 70 for access by the user through the housing 24. In the embodiment shown in the Figure, the exposed region 70 is located near the bottom of the dispensing apparatus 10. However, the dispensing apparatus 10 may incorporate other designs modifying the location of access to the propeller 60 without departing from the scope of the invention. For example, it is within the scope of the present invention to provide access to the propeller 60 near the junction of the dispenser housing 24 and application cap 26. Propeller 60 may be accessed anywhere along its length by providing a cut-out in the dispenser housing 24. The length of the propeller 60 may be adjusted accordingly. The dispenser housing 24 provides a fixed element for the user to hold while propeller 60 is rotated.

Figure 2:
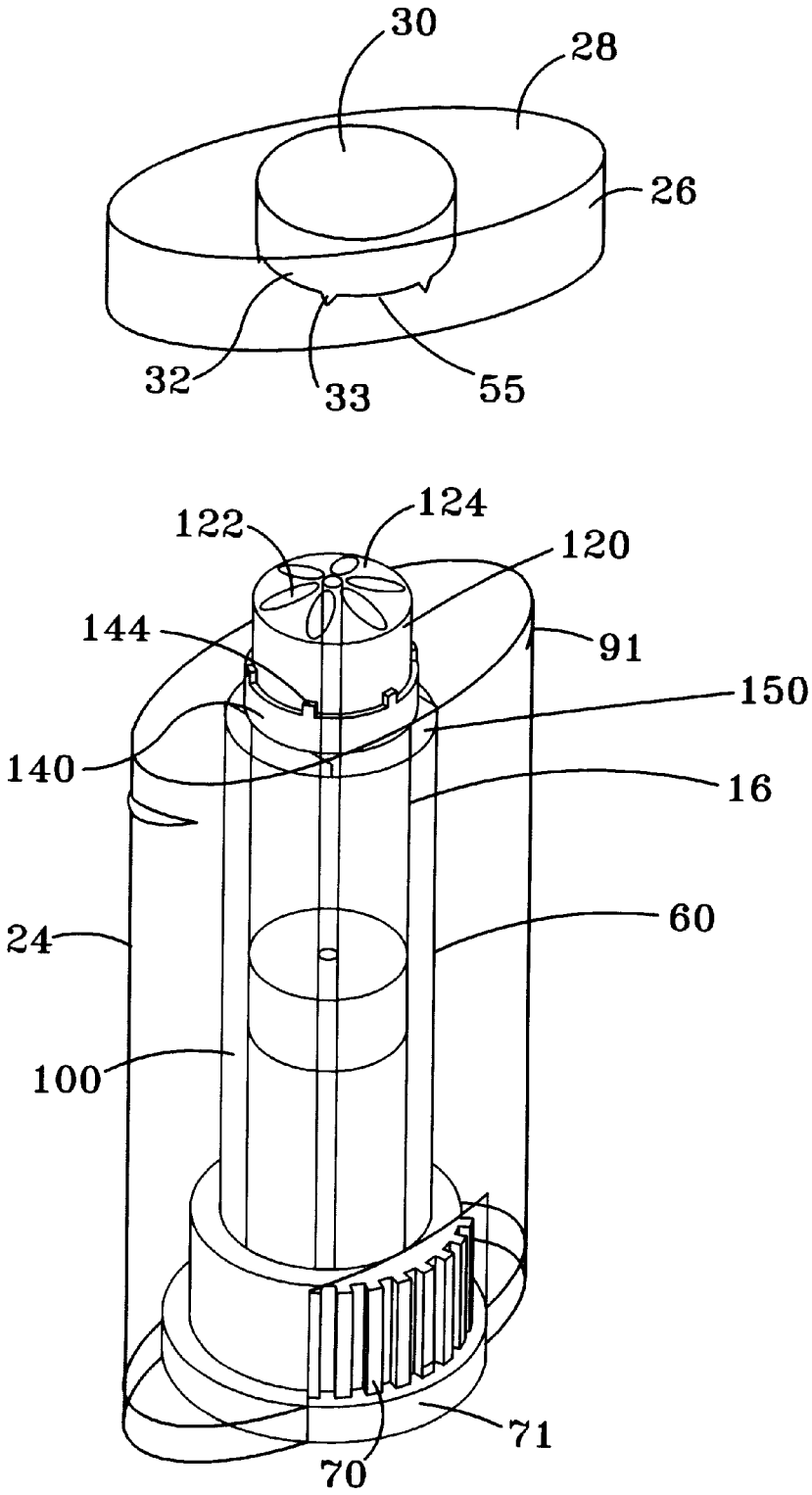
FIG. 2 is a line perspective view of a preferred embodiment of the dispensing apparatus having the applicator cap removed and showing the internal structure.

A more detailed view of the preferred embodiment is shown in FIG. 2. In the preferred embodiment, housing 24 conceals nearly all of the propeller 60 which rotates within housing 24 as will be described in greater detail below. Propeller 60 includes an axially disposed hollow cylindrical region 100 which extends from the base 70. The base 70 may be ribbed, flared or otherwise adapted to be easily grasped by a user. A hollow product tube 16 is concealed within the hollow cylindrical region 100, and holds the product to be dispensed. In a preferred embodiment of the invention, rotation of propeller 60 allows for the convenient dispensing of a desired dose of product. One or more audible clicks may be heard, and tactile feedback may be felt.

The dispensing apparatus 10 further includes an application cap 26 located at the top of the dispenser housing 24. This application cap 26 preferably snaps onto the top of the dispenser housing 24 by engagement with protrusions 91. The application cap 26 includes an upper application surface 28 having a centrally located opening 30 therein. A downwardly extending flange 32 follows the contour of the opening 30. The preferred opening 30 is circular and the application cap 26 is ovate and its application surface is ovate. In a preferred embodiment of the invention, the bottom surface of the flange 32 forms a cam 55 that is useful to provide reciprocal motion of the product head 120 as will be explained in further detail below. The invention may be successfully practiced, however, without provision of a cam 55. The removable cap 80, not shown in this view, covers the application cap 26 when it is in place as is well known in the art.

The dispensing apparatus 10 further includes a product head 120 which is adapted to be received within the flange 32. Product head 120 includes a plurality of dispensing orifices 122 located within an upper surface 124. The orifices may be of any arbitrary shape, such as round or square, but preferably elliptical. It is further within the scope of the present invention to provide downwardly extending flanges (not shown) at the orifices 122 to assist in directing the product toward the application surface 28 while the product is being dispensed.

Figure 4A:
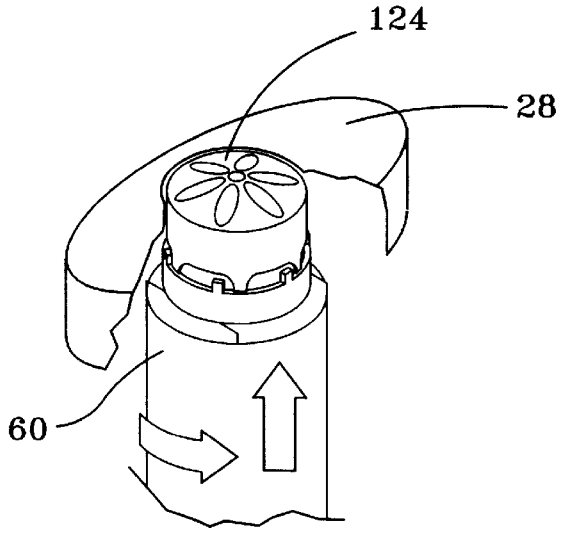
FIG. 4A is a fragmentary perspective view of a preferred embodiment showing an advanced position of the product head.
Figure 4B:
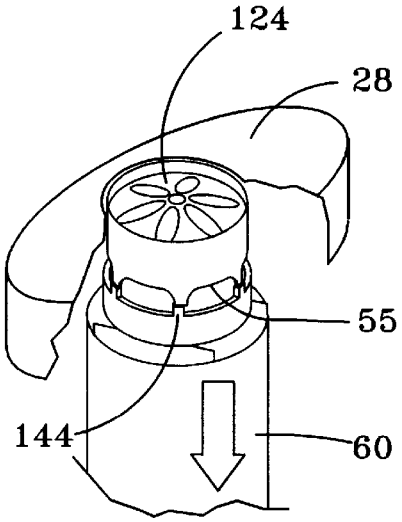
FIG. 4B is a fragmentary perspective view similar to FIG. 4A showing a retracted position of the product head.

In the preferred embodiment, the base of the product head 26 is surrounded by a collar 140 which comprises one or more cam followers 144. The collar 140 is affixed to one or more flexible strips 150 which are secured at the outer ends to the upper end of cylindrical region 100 of propeller 60. As shown in FIG. 4A and 4B, the flexible strips 150 support the product head 120 for reciprocal movement relative to propeller 60. When application cap 26 is snapped in place over the dispenser housing 24, the product head 120 is received within flange 32. In this embodiment, rotation of the propeller 60 causes the cam follower(s) 144 to ride along cam 55. The product head 120 is axially displaced upwardly or downwardly with respect to the application surface 28 by the movement of the flexible strip(s) 150. During dispensing of the product, the product head 120 is axially displaced upwardly until the upper surface 124 is generally flush with application surface 28. It should be noted that the product head 120 is rotating along with propeller 60. In a preferred embodiment, the residual pressure on the product may be relieved by reciprocation of the product head 120 by the action of the cam follower 144 against cam 55. The depth of the cam 55, the height of the cam follower 144, the properties of the flexible strip 150, or the height of the product tube 16 may be adjusted in order to achieve the desired axial displacement of the product head 120 in accordance with the properties of the dispensed product. It is within the scope of the present invention to allow the cam follower 144 to remain stationary while the cam is rotated by interchanging the locations. In the preferred embodiment, the cam 55 includes sawteeth 33 which are angled so as to allow rotation of the product head 120 in only one direction. Tactile feedback is provided to the user as the propeller 60 is rotated due to the rotation of product head 120 which causes cam follower(s) 144 to ride along cam 55. The sawteeth 33 engage the cam follower(s) 144 and then disengage upon rotation of the product head. A predetermined amount of product is dispensed in relation to each click or tactile feedback signal and thereby a user may determine a correct dosage of product.

In another embodiment of the invention, the cam 55/cam follower 144 arrangement is eliminated. However, rotation of the propeller 60 still causes rotation of the product head 120 in order to dispense the product. This embodiment does not provide for the reciprocal motion of the product head 120 and therefore does not allow relief of the residual pressure on the product.

Figure 3:
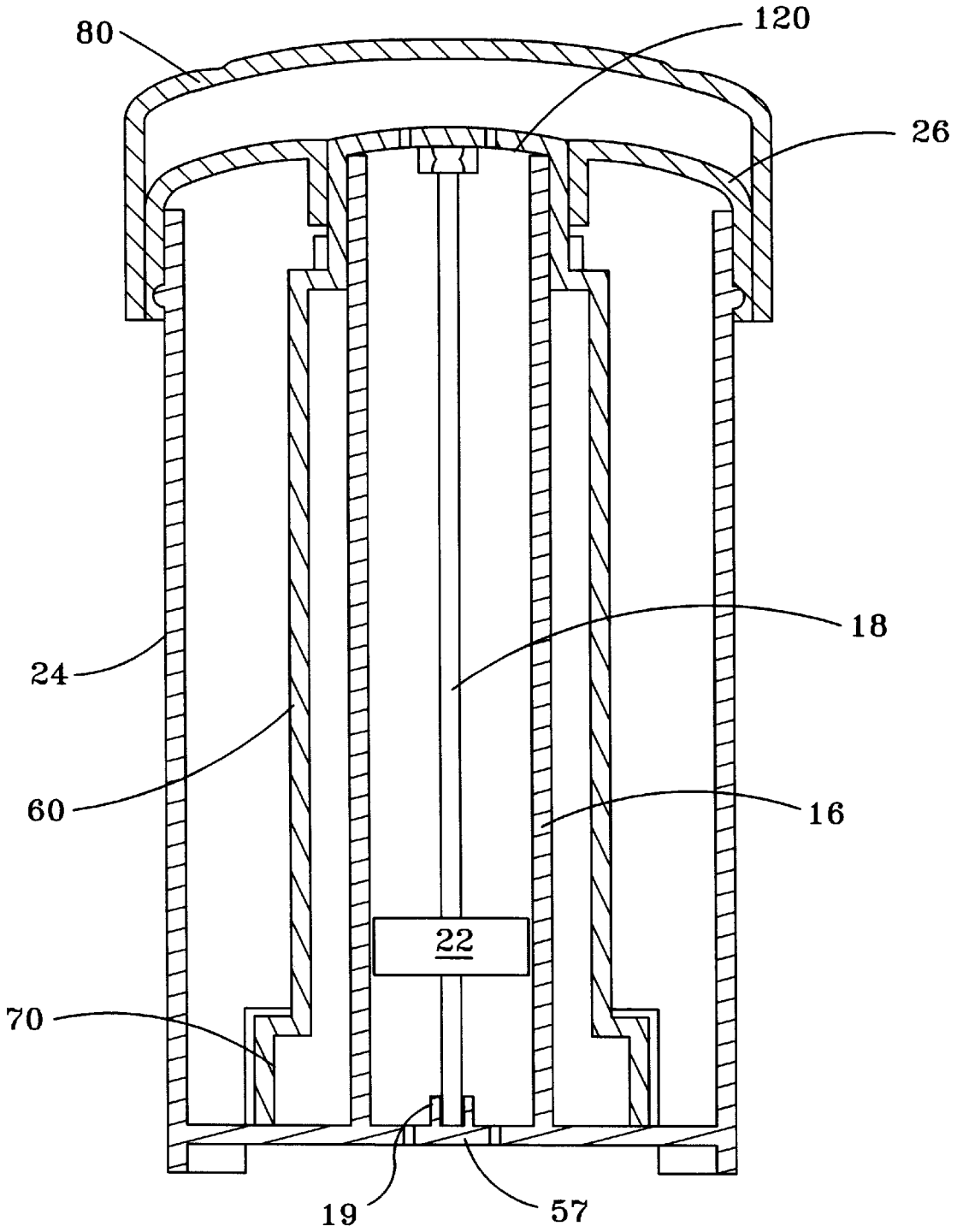
FIG. 3 is a sectional view of one embodiment of the present invention taken along line 3—3 of FIG. 1.

With reference to FIG. 3, a preferred arrangement of dispenser housing 24, propeller 60, product tube 16, application cap 26 and removable cap 80 is shown. Located within product tube 16 is a piston elevator 22 which is mounted onto a threaded spindle 18 for axial displacement within product tube 16. Spindle 18 is affixed at an upper end to the product head 120. As the propeller 60 is rotated, product head 120 rotates as does spindle 18. The rotation of spindle 18 causes upward axial displacement of the piston elevator 22. It is an important aspect of the present invention that piston elevator 22 be prevented from rotating within the product tube 16 as it advances axially. Because the end of the spindle 18 is fixedly secured to product head 120, if reciprocal motion of the product head is provided for, as in the preferred embodiment, spindle 18 will likewise reciprocate. Piston elevator 22 therefore also reciprocates with the reciprocation of the product head 120. It is this slight downward movement of the piston elevator 22 that relieves the residual pressure within the product tube 16 to minimize undesirable oozing of the product. Spindle well 19 is provided in the bottom wall 57 of the product tube 16. Spindle well 19 receives one end of spindle 18 and allows slight axial displacement of the spindle 18 while maintaining its longitudinal positioning.

Figure 7:
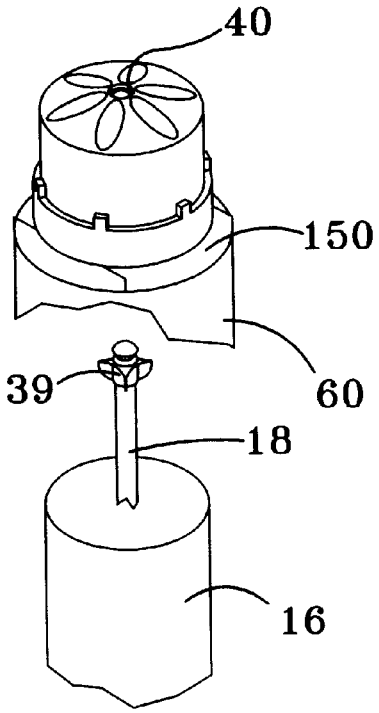
FIG. 7 is a fragmentary perspective view detailing one embodiment of the spindle and spindle head.

The product tube 16 encompasses a first cross-sectional shape that allows the axial displacement of piston elevator 22 while substantially preventing any rotation of piston elevator 22. The product tube interior may be ovate, octagonal, or the like. The exterior is round for simplicity, this feature is shown only in FIG. 7. The cross-sectional shape of the interior of the product tube 16 cooperates with the cross-sectional shape of the piston elevator 22 to effectively provide means to prevent rotation of the piston elevator 22 within the product tube 16. In the preferred embodiment, the products tube is octagonal in cross-sectional shape, while the piston elevator 22 is round or ovate. The piston elevator has resilient peripheral edges. As shown in FIG. 3, the piston elevator 22 has minimal surface area contact with the interior of product tube 16 along the top and bottom edges only of piston elevator 22. These edges provide contact bands 23 which also serve to seal the product in the product tube 16. The piston elevator 22 has a frictional fit within product tube 16 which allows upward and downward axial movement of the piston elevator with a predetermined frictional resistance. A similar frictional fit exists between the product head 120 and the product tube 16. The top of the product tube 16 is flared or flanged, as best shown in FIG. 7, so that there is minimal contact between the product tube 16 and the interior of the product head 120. The product head 120 may rotate about product tube 16 and be axially displaced relative thereto, while a seal is maintained between the product head 120 and the product tube 16. The edge around orifice 121 of the product tube 16 acts as a cleaning blade and product back flow is prevented.

With respect to FIGS. 4A and 4B, the reciprocal nature of the product head 120 is illustrated. Initial counterclockwise rotation of the propeller 60 causes movement of the cam follower 144 along cam 55 and upward axial displacement of the product head 120 until upper surface 124 is generally flush with application surface 28 (FIG. 4A). Further counterclockwise rotation of the propeller 60 causes movement of the cam follower downward, which causes the flexible strip 150 to bend downwardly. The accompanying axial reciprocation of the product head 120 causes a slight retreat of the piston elevator 22.

Figure 5A:
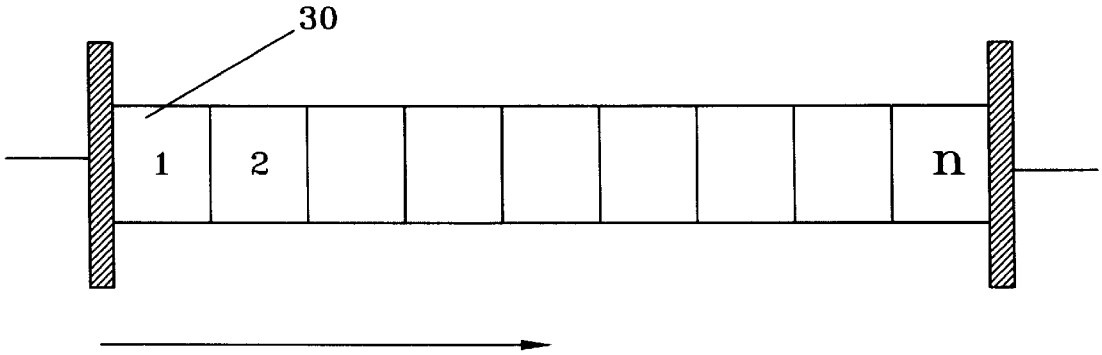
FIG. 5A is a graphical depiction showing the product dosage dispensed vs. rotation of the propeller.

FIG. 5A depicts graphically the product dosage dispensed as a function of the rotation of propeller 60.

Figure 5B:
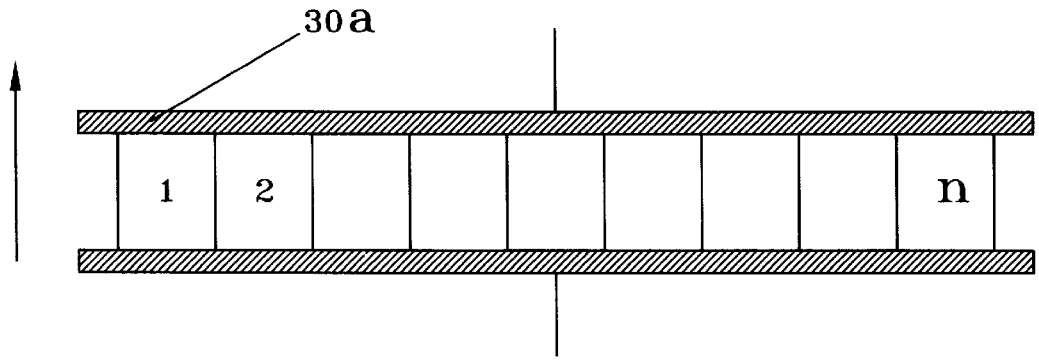
FIG. 5B is a graphical depiction showing the axial displacement of the piston elevator as a function of the propeller rotation.
Figure 5C:
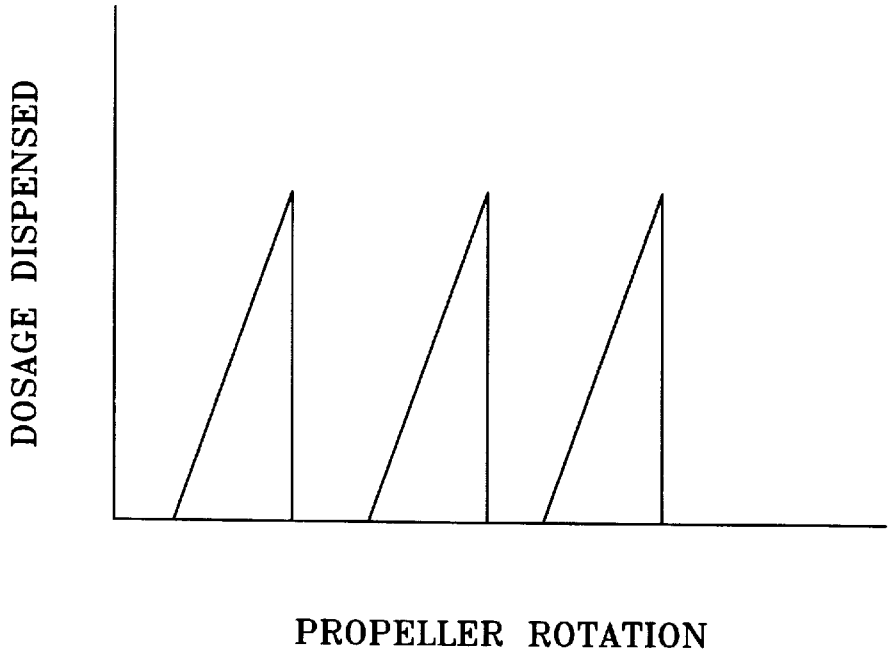
Figure 5D:
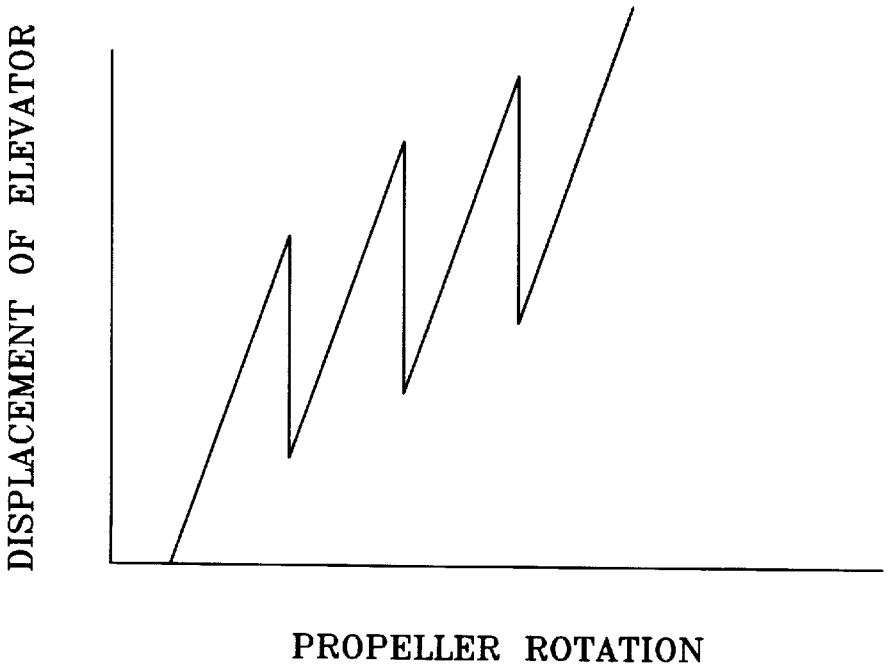

FIG. 5B depicts graphically the displacement of the piston elevator 22 as a function of rotation of propeller 60. In the preferred embodiment, the piston elevator 22 axially advances, then slightly retracts, with each rotation of the propeller 60. This movement of the piston elevator allows even dispensing of the product with each cycle of rotation of the propeller 60.

Figure 6:
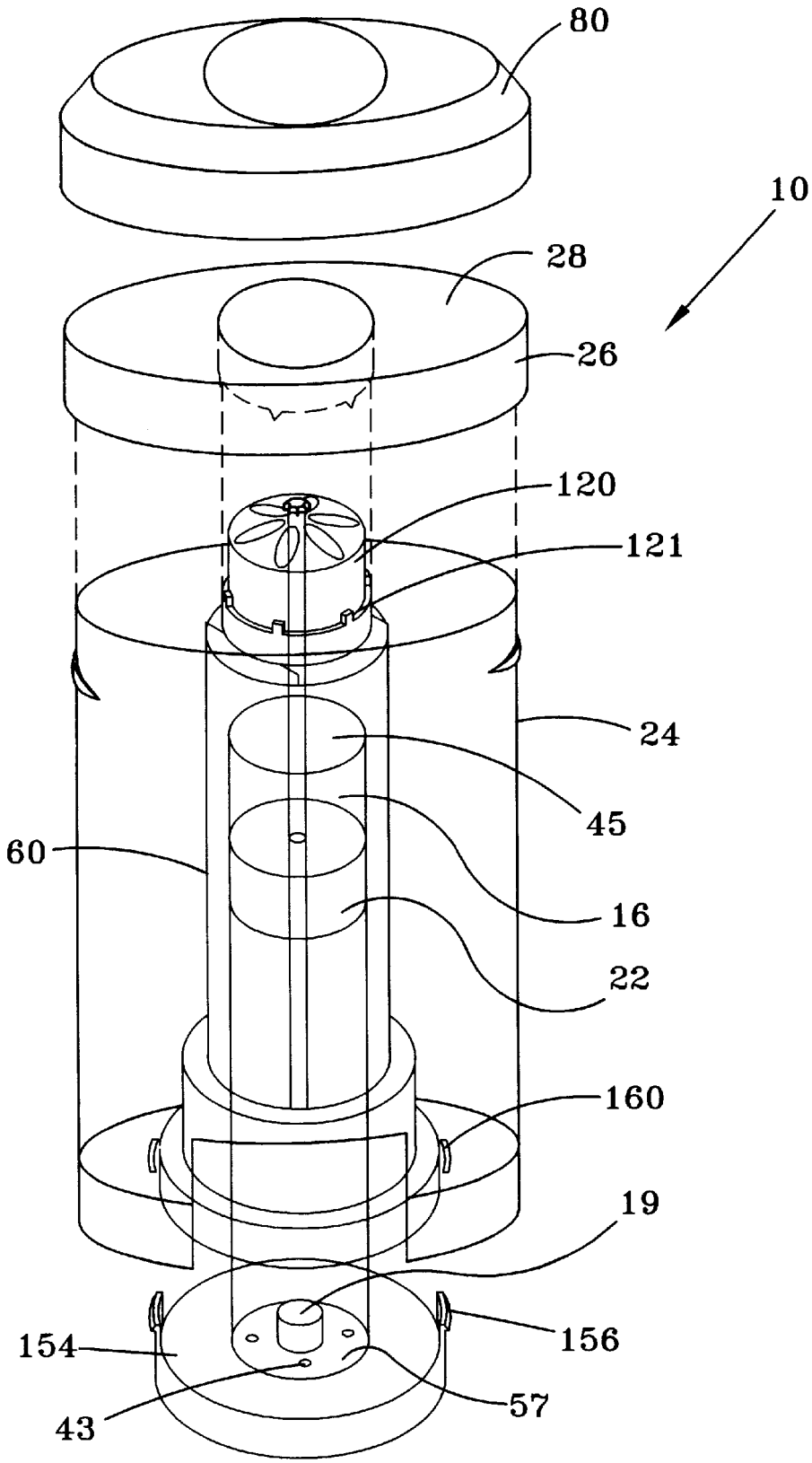
FIG. 6 is a break-away line perspective plan view of a preferred embodiment of the deodorant dispenser.
Figure 8:
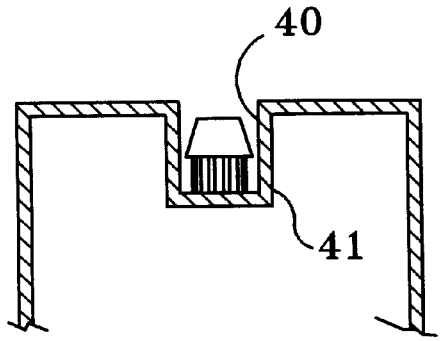
FIG. 8 is a sectional view of one embodiment of the product head showing the spindle well.

With reference to FIGS. 6, 7 and 8, the final assembly of the members of the present invention will be discussed. Product head 120 includes a centrally located spindle well 40. At the bottom of the spindle well 40 are a plurality of protrusions 41 which interact with the rudders 39 found at the upper end of the threaded spindle 18. Upon assembly of the dispensing apparatus 10, the upper end of the spindle 18 is snapped into spindle well 40. As product head 120 rotates, the protrusions 41 act upon rudders 39 to cause rotation of the spindle 18. A preferred embodiment of the spindle 18 and product head 120 has been described, but other configurations that accomplish the same purposes are within the scope of the present invention.

As shown further, the product tube 16 has a plurality of vent holes 43 in the closed bottom wall 57 in order to alleviate pressurization when inserting the piston elevator 22 and spindle 18 axially downward through the product tube 16. These vent holes 43 permit the entrapped air to be displaced while equalizing the internal air pressure in the interior of the product tube 16, when positioning the piston elevator 22. In addition, these vent holes 43 prevent the formation of a vacuum under the piston elevator 22 as it moved upwardly, thereby alleviating drawing the product around the piston into the spatial vacuum.

In one embodiment, the housing 24 includes a base 154 that is snap fitted onto the container wall by engagement of prongs 156 in openings 160. In another preferred embodiment, the base 154 is integrally molded with the container wall. Also, in a preferred embodiment, the container wall, base 154, and product tube 16 are all integrally molded, as shown in the embodiment illustrated in FIG. 3. Therefore, the bottom wall 57 of the product tube 16 also functions as the base 154 of the housing 24.

One preferred method of assembling the dispenser apparatus 10 includes positioning the product tube 16 onto base 154, if these are separate components. Also, the housing 24 may be properly positioned now, or after the product tube is filled. The piston elevator 22 is then positioned in the bottom of product tube 16 . As stated above, the vent holes 43 prevent air from being trapped beneath the piston elevator 22. The product tube 16 may then be filled with appropriate product. The spindle 18 may be inserted into the product tube 16, and rotated to engage the piston elevator 22 and inserting the end of the spindle 18 into spindle well 19. The propeller 60/product head 120 assembly is then fixedly secured to the top of spindle 18 by engagement of the top of the spindle 18 into spindle well 40. It is also possible to position the housing 24 after the propeller 60/product head 120 assembly is positioned. The application cap 26 is then securely fastened to housing 24. The assembly of the dispensing apparatus 10 is simplified if the housing 24, base 154, and product tube 16 are integrally molded. It also within the scope of this invention that the spindle 18, piston elevator 22 are preassembled and installed within the product tube 16 prior to filling of tube 16.

Cylindrical region 100 and propeller 60 rotatably relate to a single thread at the base of housing 24 and maintain association to the product tube base 154, which forms a bottom closure.

While the invention has been described in connection with specific embodiments and applications, no intention to restrict the invention to the examples shown is contemplated. It will be apparent to those skilled in the art that the above methods may incorporated changes and modifications without departing from the general scope of the invention. It is intended to include all such modifications and alterations in so far as they come within the scope of the appended claims or the equivalents thereof.

Having thus described the invention, it is now claimed:

1. A dispensing apparatus comprising:

a hollow housing having a central longitudinal axis and a container wall;

an application cap secured to said container wall at a top of said housing, said application cap having an application surface having a central opening therein and a downwardly extending flange located about said central opening;

a hollow product tube having a bottom wall and an open top end, said product tube being received within said housing and being spaced from said container wall, said product tube being disposed about said longitudinal axis and being adapted to contain an associated product;

a rotatable threaded spindle disposed along said longitudinal axis, a first end of said spindle being received in a spindle well located in said bottom wall of said product tube;

a piston elevator being mounted onto said spindle for axial movement within said product tube;

rotational prevention means for preventing rotation of said piston elevator within said product tube;

rotatable drive means for rotation of said threaded spindle, said drive means being fixedly secured to a second end of said spindle, said drive means comprising a rotatable propeller and a hollow product head having an upper surface and an open lower end, said product head being affixed to said propeller and rotatable therewith, said open lower end of said product head communicating with said open top end of said product tube and said upper surface of said product head being received within said flange of said application cap;

directing means for directing said associated product from said product tube to said application surface, said directing means comprising a plurality of orifices in said upper surface of said product head; and, a base connected to said container wall wherein said base includes said bottom wall of said product tube.

2. The dispensing apparatus of claim 1 further comprising:

reciprocating means for reciprocating said product head within said flange of said application cap.

3. The dispensing apparatus of claim 2 wherein said reciprocating means comprises:

a cam located at a bottom of said flange;

a cam follower being rotatable with said product head and contacting said cam; and, a flexible strip extending between said product head and said propeller, said flexible strip being able to displace axially in response to movement of said cam follower along said cam.

4. The dispensing apparatus of claim 1 wherein said bottom wall of said product tube is integrally molded with said housing.

5. The dispensing apparatus of claim 1 wherein said bottom wall of said product tube includes a plurality of vent holes therein.

6. The dispensing apparatus of claim 1 wherein said:

base is selectively secured to said container wall.

7. The dispensing apparatus of claim 1 wherein said:

base is integrally formed with said container wall.

8. The dispensing apparatus of claim 1 wherein said base, said product tube and said container wall are integrally molded as a single member.

9. The dispensing apparatus of claim 1 further comprising:

dosing means for dispensing a uniform dose of said associated product.

10. A dispensing apparatus comprising:

a hollow housing having a central longitudinal axis and a container wall;

an application cap secured to said container wall at a top of said housing;

a hollow product tube having a bottom wall, said product tube being received within said housing and being spaced from said container wall, said product tube being disposed about said longitudinal axis and being adapted to contain an associated product;

a rotatable threaded spindle disposed along said longitudinal axis, a first end of said spindle being received in a spindle well located in said bottom wall of said product tube;

a piston elevator being mounted onto said spindle for axial movement within said product tube; and, drive means for rotation of said threaded spindle, said drive means being fixedly secured to a second end of said spindle.

11. The dispensing apparatus of claim 10 wherein said drive means comprises:

a rotatable propeller;

a hollow product head having an upper surface and an open lower end, said product head being attached to said propeller and rotatable therewith.

12. A method for assembling the dispensing apparatus of claim 1 including the steps of:

a. mounting said piston elevator onto said spindle;

b. positioning said spindle with respect to said product tube so that said first end of said spindle is received into said spindle well in said bottom wall of said product tube;

c. fixedly securing said drive means to a second end of said spindle after said step of positioning said spindle;

d. positioning said product tube along said longitudinal axis of said housing;

e. securing said application cap to said container wall.

13. The dispensing apparatus of claim 1 wherein:

said product tube has an interior associated with a first predetermined cross-sectional shape;

said piston elevator is associated with a second predetermined cross-sectional shape; and, said first cross-sectional shape and said second cross-sectional shape cooperate to effectively form said rotational prevention means.

* * * * *